US006032293A

United States Patent [19]

Makki

[11] Patent Number: 6,032,293

[45] Date of Patent: Mar. 7, 2000

[54] HAT ORNAMENTAL ILLUMINATION CIRCUIT ACCESSORY

[76] Inventor: Farhad Seyed Makki, 29 Cross Laurel Ct., Germantown, Md. 20876

[21] Appl. No.: 09/129,517

[22] Filed: Aug. 5, 1998

[51] Int. Cl.[7] ..... A42C 5/00

[52] U.S. Cl. ..... 2/209.13; 2/195.1; 2/244; 2/906; 362/106

[58] Field of Search ..... 2/209.13, 906, 2/195.1, 244; 362/106

[56] References Cited

U.S. PATENT DOCUMENTS 4,665,568 5/1987 Stutes ..... 2/209.13

*Primary Examiner*—Diana Oleksa
*Attorney, Agent, or Firm*—Michael W. York

[57] ABSTRACT

An ornamental circuit accessory for use with a hat. The ornamental circuit accessory has light emitting diodes for being mounted on the hat for being viewed by individuals viewing the hat and the terminals of the diodes and the circuitry for controlling the diodes are adapted to be concealed within the hat by the person wearing the hat. The control circuitry includes an electronic clock which sends electric pulses to an electronic counter, the output of which passes through a decoder that controls which diodes are sequentially illuminated (Example Only) for providing a type of additional ornamentation for the wearer of the hat.

2 Claims, 3 Drawing Sheets

HAT ORNAMENTAL ILLUMINATION CIRCUIT ACCESSORY

BACKGROUND OF THE INVENTION

There are numerous articles of wearing apparel that have decorative or ornamental illumination incorporated into the article. For instance, articles of wearing apparel such as a hats, shoes, shirts and neckties have been made that contained illumination devices such as lights. In such prior articles, the illumination means such as lights have been an integral part of the articles. Consequently, the device had one fixed illumination display. This meant that the hat or other article of clothing was manufactured for one particular type of use associated with the display and there was no alternative or other use for the article.

Even with articles that might have their light displays altered or changed, such as by altering the circuit that controls illumination, it was still not possible to use the article such as a hat without the illumination display. This placed a definite limit on the usefulness for the illuminated articles such as a hat. With such articles or hats this single use problem is compounded by the fact that the hat may also have decorative features in addition to the illumination decoration. Examples of such hats are the various caps that have logos and the like on them that are used by the various football, baseball and other sports teams. Such logos already limit the appeal of such hats to those who support a particular team and then the addition of light emitters even further restricts the number of individuals who might be interested in such a cap or hat.

Consequently, it would be very advantageous to expand the portion of the population that might be interested in the illuminated hat and to provide the prospective purchaser and user of the hat with more options in terms of uses for the hat. Another problem with hats that have their illumination means contained therein is that the hat can not be readily washed or cleaned without the risk of damaging the illumination means that is attached to the hat.

The new hat ornamental illumination circuit accessory of this invention overcomes these problems and provides ornamental illumination for a hat that is designed to be separate from the hat until it is put into use. This permits the hat to be used without any lights or illumination for normal protective or similar uses. Then when it is desired, the user of the hat can convert it into a decorative hat by adding the necessary hat ornamental illumination circuit to the hat. In addition, due to the construction of the hat ornamental illumination circuit accessory that has a large portion sized and shaped to be concealed within the hat it is not readily apparent to those individuals viewing the illuminated hat that the illumination apparatus is readily detachable from the hat.

When the need or desire for an illuminated hat has passed, the user of the hat can readily remove the ornamental illumination circuit accessory and use the hat without any illumination. The ornamental illumination circuit accessory invention also has provisions for enabling its lights to be connected to hats having different construction.

SUMMARY OF THE INVENTION

This invention relates to hats with illumination and the like and more particularly to hats with ornamental illumination.

Accordingly, it is an object of the invention to provide a hat illumination circuit accessory that adds versatility to the hat.

It is an object of the invention to provide a hat illumination circuit accessory adapted to be added to a variety of hats.

It is an object of the invention to provide a hat illumination circuit accessory that is easy to add to and remove from a hat.

It is an object of the invention to provide a hat illumination circuit accessory uses existing hat structure to connect it to the hat.

It is an object of the invention to provide a hat illumination circuit accessory that uses the ventilation holes in the hat for display purposes.

It is an object of the invention to provide a hat illumination circuit accessory that uses the ventilation holes in the hat for connection purposes.

It is an object of the invention to provide a hat illumination circuit accessory has adapters for use with different size ventilation holes in various hats.

It is an object of the invention to provide a hat illumination circuit accessory that can be used with existing hats.

It is an object of the invention to provide a hat illumination circuit accessory that is predominately concealed within the hat structure when in use.

It is an object of the invention to provide a hat illumination circuit accessory that only displays the light emitting means when in use on the hat.

It is an object of the invention to provide a hat illumination circuit accessory that is simple in its operation.

It is an object of the invention to provide a hat illumination circuit accessory that is easy to manufacture.

It is an object of the invention to provide a hat illumination circuit accessory that is inexpensive to manufacture.

It is an object of the invention to provide a hat illumination circuit accessory that produces an eye catching light display.

It is an object of the invention to provide a hat illumination circuit accessory that readily attracts attention to the wearer of the hat.

These and other objects will be apparent from the ornamental circuit for use with a hat invention that includes an ornamental circuit having light emitting diodes adapted to be mounted on the hat for being viewed by individuals viewing the hat, circuitry for controlling the diodes with the terminals of the diodes and the circuitry for controlling the diodes are adapted to be concealed within the hat by the person wearing the hat. The control circuitry includes a flash integrated circuit for sequentially illuminating the diodes to provide ornamentation for the wearer of the hat or additional ornamentation for the wearer of the hat in the case where the hat already has some ornamentation.

BRIEF DESCRIPTION OF THE DRAWINGS

The invention will be hereinafter more fully described with references to the accompanying drawings in which.

DETAILED DESCRIPTION OF THE PREFERRED EMBODIMENT

Figure 1:
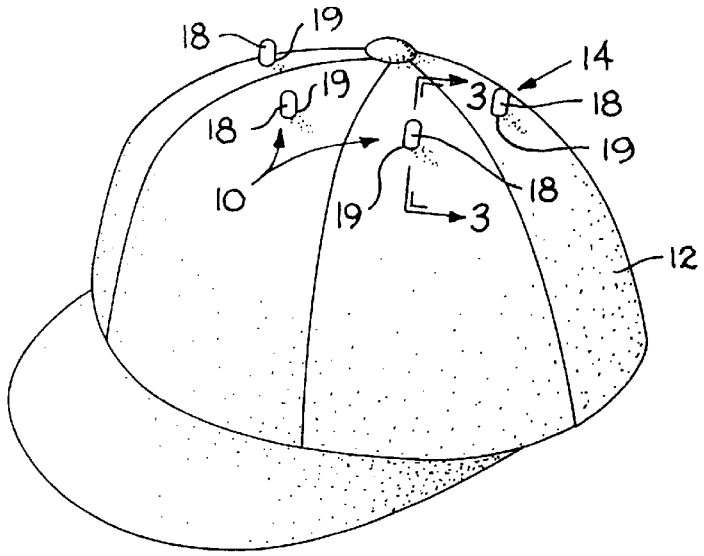
FIG. 1 is a perspective view of a hat with certain portions broken away illustrating the invention in use on a hat.
Figure 2:
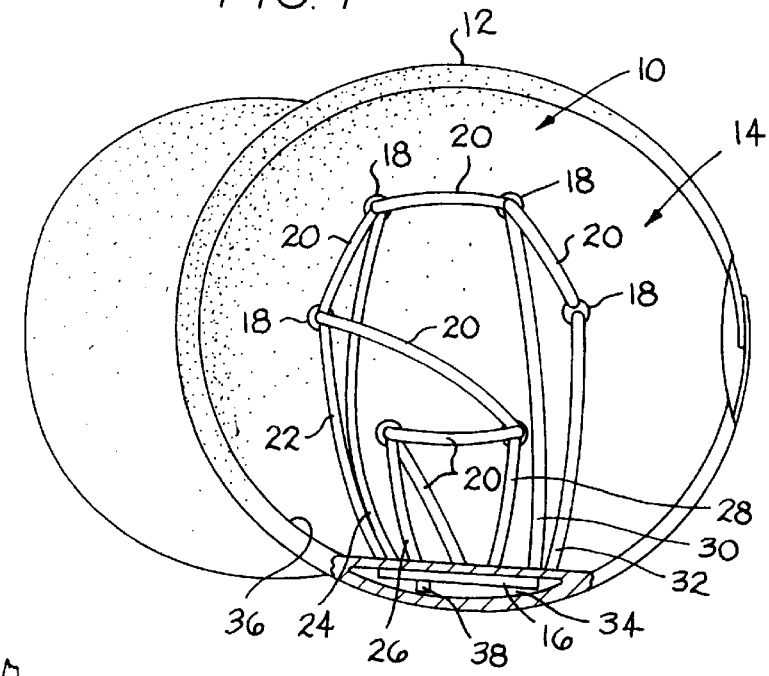
FIG. 2 is a bottom plan view of the hat set forth in FIG. 1 with certain portions broken away illustrating portions of the invention in use in the interior of a hat.
Figure 3:
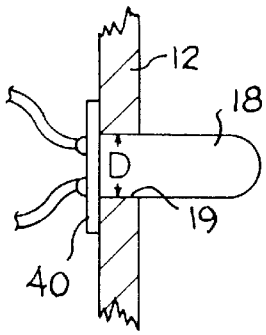
FIG. 3 is an enlarged sectional view of a portion of the structure set forth in FIG. 1 taken along the line 3—3 thereof illustrating how a light emitting device, such as a diode, that forms part of the invention is held in place on a hat.

Referring first to FIGS. 1 through 3 and FIG. 5, the hat ornamental illumination circuit accessory invention is illustrated and is designated generally by the number 10. As illustrated in FIGS. 1 through 3, the ornamental illumination circuit accessory invention 10 is illustrated as being located on and connected to a hat designated by the number 12. The hat ornamental illumination circuit accessory invention 10 comprises a light emitting array 14 and a battery and circuit pack 16. The light emitting array 14 includes a plurality of light emitting devices such as light emitting diodes or miniature lights that are designated by the number 18. These light emitting devices 18 fit through the normal ventilation holes 19 in the hat 12, and the light emitting devices 18 are sized and shaped for a friction fit in the holes 19. These light emitting devices 18, as illustrated in FIG. 2, are interconnected by an electrically conductive lead or wire 20. In addition, each individual light emitting device 18 is electrically connected by the respective electrically conductive leads or wires 22, 24, 26, 28, 30 and 32 that are connected to the appropriate electrical contacts on an integrated circuit on the battery and circuit pack 16 that will hereinafter be described.

As illustrated in FIG. 2, the battery and circuit pack 16 is sized and shaped to be located within a pocket or space 34 that is normally present in the hatband 36 that is conventionally present in most types of hats. The battery and circuit pack 16 has a switch 38 that is located on the battery and circuit pack 16 in position to be readily activated manually by the wearer or potential wearer of the hat 12.

FIG. 3 illustrates in detail how the light emitting device 18 is located on and secured to the hat 12. As indicated previously, the hat 12 has a series of holes or apertures 19 that are circular in shape. The light emitting device 18 in the preferred embodiment is generally cylindrical shaped with a diameter D that is slightly larger than the diameter of the hole 19 so that when the light emitting device 18 is inserted into the hole 19 in the hat 12 the light emitting device 18 is held in place by friction between the exterior of the light emitting device 18 and the surface of the hole 19 in the hat 12. As indicated, a circular shaped thin stop 40 is located at the base of the light emitting device 18 so that it cannot be pushed through the hole 19 in the hat 12.

Figure 4:
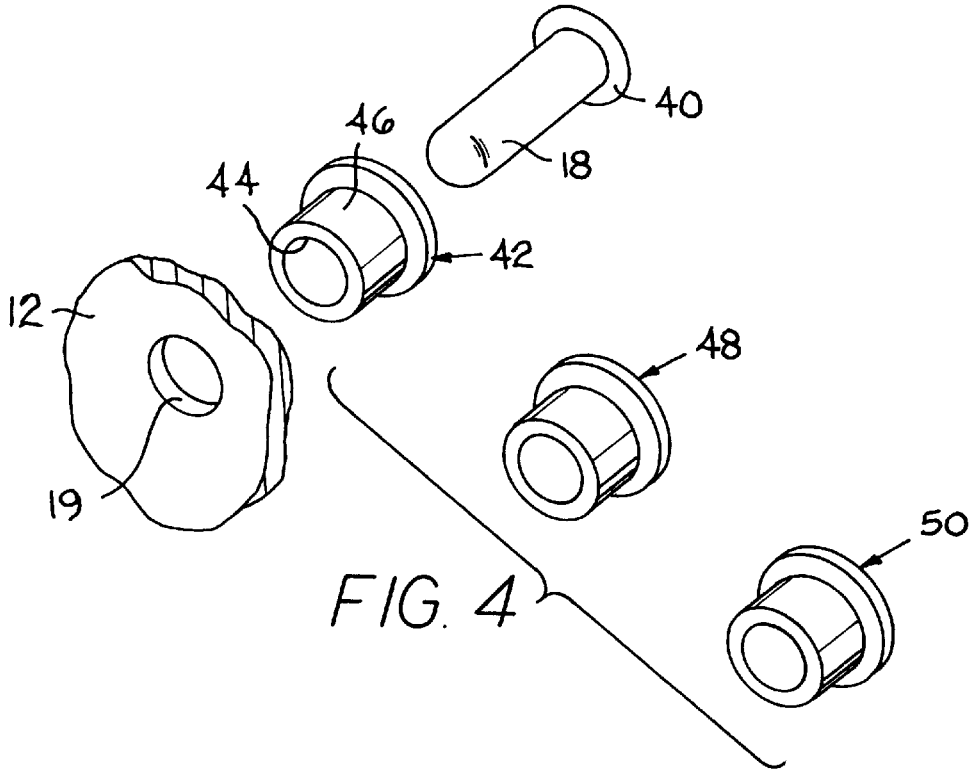
FIG. 4 is a perspective view of a light emitting device forming part of the invention and additional components that also form part of the invention.

As illustrated in FIG. 4 in the preferred embodiment of the invention, if the hole 19 is too large, an insert 42 that has a hole 44 that permits the insert 42 to fit over the light emitting device 18. This insert 42 has a projecting portion 46 that is sized and shaped to fit in the hole 19. Additional inserts 48 and 50 can be provided for other size holes 19 so that there is an array of adapter inserts for different size holes 19. This permits the light emitting diodes 18 to work with various hats 12 that have different size ventilation holes 19.

Figure 5:
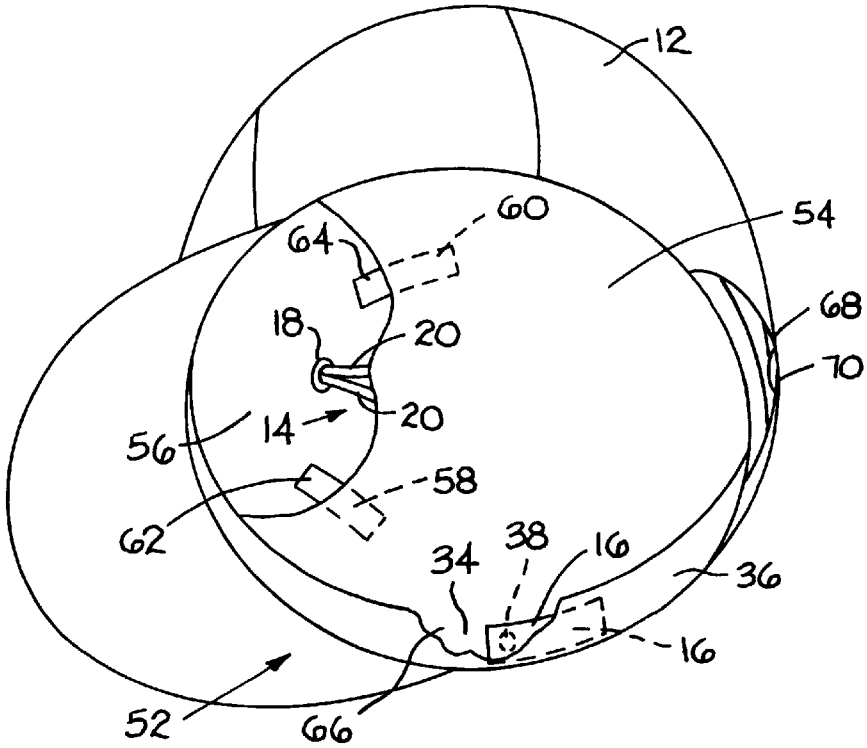
FIG. 5 is a perspective view of the hat set forth in FIGS. 1 through 3 but illustrating a liner that forms part of an additional embodiment of the invention.

FIG. 5 illustrates an additional embodiment of the previously described hat ornamental illumination circuit accessory invention 10 and as indicated previously it is adapted to be connected to a hat 12. This hat ornamental illumination circuit accessory invention is designated generally by the number 52 and includes a light emitting array 14 that has light emitting devices such as the light emitting diodes 18 and a battery and circuit pack 16 that is also sized and shaped to be located within a pocket or space 34 in the hatband 36. The battery and circuit pack 16 also has a switch 38 positioned to be activated by the wearer of the hat 12.

However, the hat ornamental illumination circuit accessory invention 52 as illustrated in FIG. 5 has another item that is not present in the previously described hat ornamental illumination circuit accessory invention 10 set forth in FIGS. 1 through 3. This basic additional item is a cloth hat liner 54 that is sized and shaped to fit into the underside 56 of the hat 12 as illustrated in FIG. 5. As illustrated in FIG. 5, the hat liner 54 is held in place by a series of hook and loop fasteners such as VELCRO fasteners, such as the VELCRO fasteners 58 and 60 that are fastened to the upper side of the hat liner 54 and patches of VELCRO material such as the patches 62 and 64 that can be manually fastened at appropriate locations on the underside surface 56 of the hat 12 by pressing them in place with a pressure sensitive adhesive.

This permits the user of the hat 12 to place the patches, such as the patches 62 and 64, at appropriate locations on the underside 56 of the hat 12 where the hook and loop fasteners such as VELCRO patches 62 and 64 are present. The user can also stuff the edge portion 66 of the hat liner 54 inside the hatband 36 of the hat 12. It should be noted that the hat liner 54 generally conforms to the size and shape of the inside surface 56 of the hat and includes a cut out portion 68 that matches the normally present cut out portion 70 on the hat 12.

Figure 6:
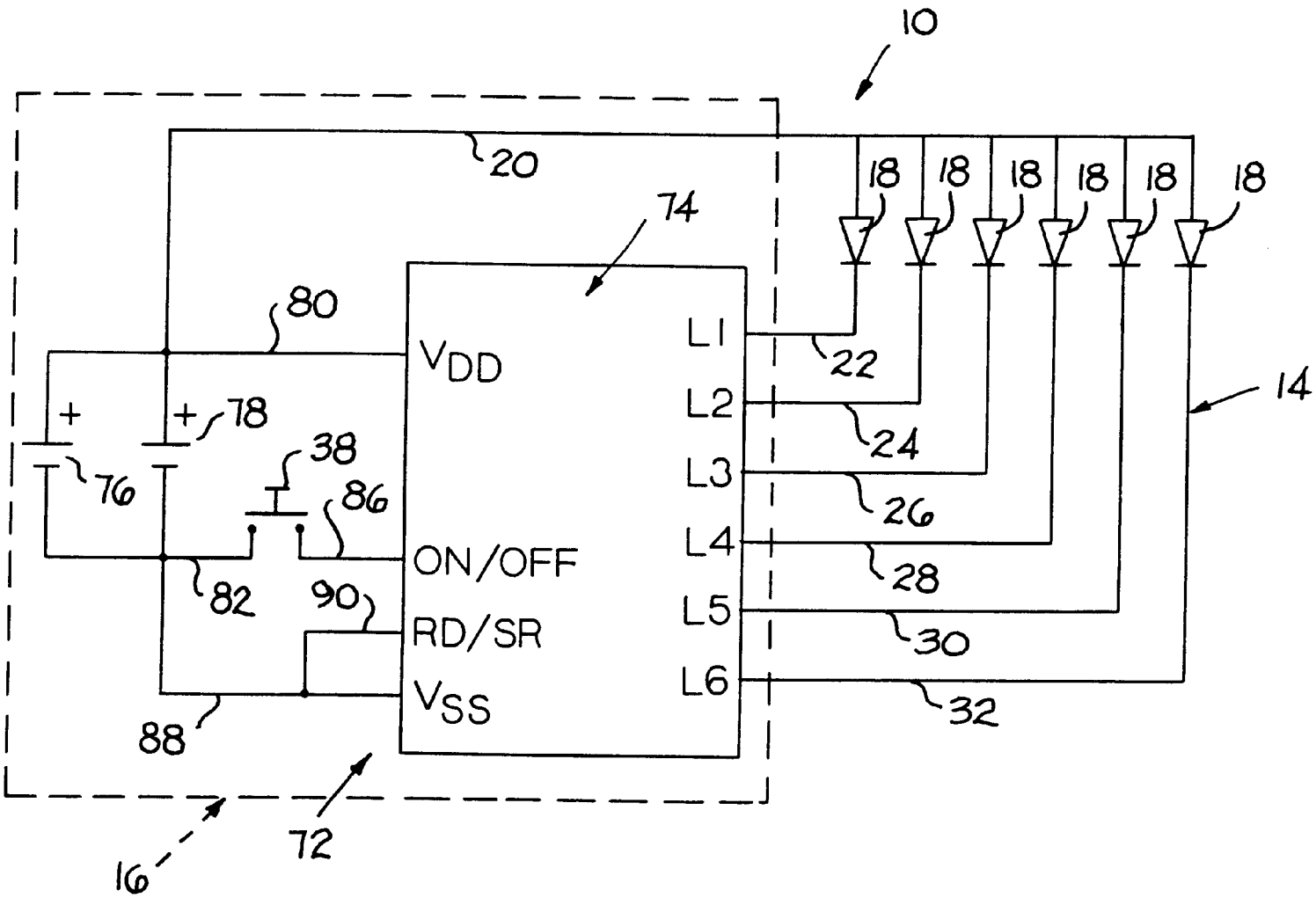
FIG. 6 is a circuit diagram of a circuit that forms part of the invention.

FIG. 6 is a circuit diagram of the light emitting diode array 14 and the battery and circuit pack 16 of the hat ornamental illumination circuit accessory invention 10. The hat ornamental illumination circuit accessory invention 10 circuit is designated generally by the number 72 and includes a flash integrated circuit IC 74, known in the art, that in the preferred embodiment has a frequency to produce one flash a second±20%, two 3 volt batteries 76 and 78 connected in parallel that in the preferred embodiment are designated CR2032 and the previously mentioned light emitting diode array 14.

The positive terminals of the batteries are connected to terminal $V_{DD}$ on the integrated circuit 74 via the lead or circuit path 80. The negative terminals of the batteries 76 and 78 are connected via the lead 82, the push bottom switch 38 and lead 86 to the integrated circuit 74 ON/OFF terminal and to the terminals Vss and RD/SR via the leads 88 and 90. This integrated circuit 74 has terminals L1, L2, L3, L4, L5 and L6 that are connected to the light emitting diodes 18 via the respective electrically conductive paths or leads 22, 24, 26, 28, 30 and 32 and the diodes 18 are connected to the positive terminals of the batteries 76 and 78 and to $V_{DD}$ via the conductive lead or path 20.

The embodiments of the hat ornamental illumination circuit accessory invention 10 and 52 are made and used in the following manner. All of the components of the invention embodiments 10 and 52 are in themselves known in the art and are readily available or easily formed from commercially available materials. The battery and circuit pack 16 is formed by cutting from an ordinary piece of thin circuit board and should be small in size to fit inside the hat band 36 of the hat 12. In the preferred embodiment this thin circuit board is 68.2 mm by 25.4 mm.

The integrated circuit 74, the batteries 76 and 78, the switch 38 and the associated circuitry are all attached to the circuit board using conventional techniques to form the battery and circuit pack 16. The switch 38 is located on the pack 16 where it can be manually operated by pressure through the fabric of the hat 12 when the pack 16 is located inside the hat band 36 Electrically conductive flexible wires 22, 24, 26, 28, 30 and 32 have their one end soldered to the respective contacts or terminals L1, L2, L3, L4, L5 and L6 on the integrated circuit 74 and a flexible electrical conductor 20 is soldered to the light emitting diodes 18 and to the $V_{DD}$ terminal on the integrated circuit 74. This will leave the light emitting array 14 extending from the battery and circuit pack 16 so that it can be moved about by the person using the hat ornamental illumination circuit 10 and 52.

The various inserts 42, 48 and 50 are machined from plastic or molded from plastic and are made of a suitable size to fit with a friction fit into various size hat air or ventilation holes. The cloth hat liner 54 is cut from a suitable hat lining cloth known in the art to a suitable size to fit into the underside 56 of the hat 12. Rectangular shaped hook and loop fasteners such as VELCRO fasteners, such as the fasteners 58 and 60 are cut and have their back sides attached to upper sides of the hat liner 54 by sewing or with permanent glue. Suitable matching VELCRO patches 62 and 64 are also cut and have their back sides coated with a suitable pressure sensitive adhesive.

In order to use the hat ornamental illumination circuit accessory invention 10, the user inserts the light emitting diodes 18 into the air or ventilation holes, such as the holes 19, in a hat 12 and then places the battery and circuit pack 16 into the space behind the hat band 36 of the hat 12. Then, when the user wants the light emitting diodes 18 to light, the switch 38 is pushed by manually putting pressure on the portion of the hat 12 adjacent the switch 38 to activate the circuit 72 and cause the light emitting diodes 18 to flash on and off sequentially.

If use of the liner 54 is desired, the user attaches the hook and loop fasteners such as VELCRO patches, such as the patches 62 and 64, using the pressure sensitive adhesive on their back sides by pushing on them at suitable locations on the underside 56 of the hat 12. The VELCRO fasteners 58 and 60 on the hat liner 54 are then placed on these patches 62 and 64 to hold the liner 54 in place. The outer end of the liner 54 can then be stuffed into the space behind the hatband 36.

After use, the user merely presses the switch 38 by manually putting pressure on the portion of the hat 12 adjacent the switch 38 to stop the light emitting diodes from being illuminated. If desired the hat liner 54, if any, can be removed by manually pulling on it. Then the battery and circuit pack 16 can be removed by manually pulling it from behind the hat band 36. The various light emitting diodes 18 can be removed by manually pushing them from outside the hat 12 inward. Any inserts, such as the inserts 42, 48 or 50 can then be removed by manually pulling them inward and this completes the removal of the hat ornamental illumination circuit accessory invention 10 or 52 that can then be stored until future use.

Although the invention has been described in considerable detail with reference to a certain preferred embodiments, it will be understood that variations or modifications may be made within the spirit and scope of the invention as defined in the appended claims.

What is claimed is:

1. A hat illumination circuit accessory for use on a hat having a plurality of circular shaped holes and a hat band comprising a plurality of light emitting devices each having a base portion and a generally cylindrical shaped portion, electronic circuit means connected to said plurality of light emitting devices for illuminating said light emitting devices, power supply means for supplying electric power to said electronic circuit means and switch means interconnecting said power supply means and said electronic circuit means, said plurality of light emitting devices, said electronic circuit means, said power supply means and said switch means being sized and shaped to be located on said hat with said electronic circuit means and said power supply means being locatable within said hat band, said generally cylindrical shaped portion of each of said light emitting devices having a diameter adapted to be slightly larger than the diameter of the hole in said hat into which said light emitting device is to be inserted whereby said emitting device is held in place by friction between the exterior of the the generally cylindrical portion of said light emitting device and the surface of said hole in said hat with a portion thereof visible outside said hat and wherein the base of said light emitting device has a stop to prevent said light emitting device from being pushed through the hole in said hat.

2. The hat illumination circuit accessory of claim 1 wherein said said electronic circuit means comprises means for causing said light emitting devices to illuminate sequentially.

* * * * *